US005141162A

United States Patent [19]

Gunderson et al.

[11] Patent Number: 5,141,162

[45] Date of Patent: Aug. 25, 1992

[54] VARIABLE INLET SPRAYING APPARATUS

[75] Inventors: Richard Gunderson, Elk River; Richard L. Soderlind, Grand Marais, both of Minn.

[73] Assignee: Wagner Spray Tech Corporation, Minneapollis, Minn.

[21] Appl. No.: 819,595

[22] Filed: Jan. 9, 1992

Related U.S. Application Data

[63] Continuation of Ser. No. 427,501, Oct. 27, 1989, abandoned.

[51] Int. Cl.[5] ..... B05B 9/03; B05B 1/30

[52] U.S. Cl. ..... 239/332; 239/531.2; 239/586; 222/310

[58] Field of Search ..... 239/332, 586, 581.2, 239/581.1, 310; 222/630, 282, 310; 137/893, 894; 251/215

[56] References Cited

U.S. PATENT DOCUMENTS

| | | | |
|---|---|---|---|
| 2,013,639 | 9/1935 | Steinhart et al. | 239/332 |
| 2,285,689 | 6/1942 | Tullis | 239/586 |
| 2,536,361 | 1/1951 | Flanders | 222/630 |
| 2,648,017 | 8/1953 | Ziherl | 239/332 |
| 2,721,764 | 10/1955 | Wilson, Jr. | 239/581.2 |
| 2,874,719 | 2/1959 | Van Tuyl | 137/893 |
| 2,999,646 | 9/1961 | Wagner | 239/332 |
| 3,088,679 | 5/1963 | Ford | 239/318 |
| 3,116,879 | 1/1964 | Wagner | 239/332 |
| 3,120,347 | 2/1964 | Duke, Jr. | 239/332 |
| 3,445,068 | 5/1969 | Wagner | 239/332 |
| 3,476,052 | 11/1969 | Wagner | 417/441 |
| 3,680,789 | 8/1972 | Wagner | 239/332 |
| 3,820,564 | 6/1974 | Wagner | 251/215 |
| 3,894,816 | 7/1975 | Davis et al. | 417/413 |
| 4,160,525 | 7/1979 | Wagner | 239/332 |
| 4,160,525 | 7/1979 | Wagner | 239/332 |
| 4,189,100 | 2/1980 | Karp | 239/310 |
| 4,238,074 | 12/1980 | Coons | 239/310 |
| 4,403,924 | 9/1983 | Gebauer et al. | 417/388 |
| 4,615,485 | 10/1986 | Larson et al. | 251/215 |
| 4,705,995 | 11/1987 | Boll | 318/129 |
| 4,744,516 | 5/1988 | Peterson et al. | 239/128 |
| 4,834,286 | 5/1989 | Sulz | 239/332 |
| 4,901,765 | 2/1990 | Poe | 137/893 |

FOREIGN PATENT DOCUMENTS

| | | | |
|---|---|---|---|
| 21041 | 1/1904 | United Kingdom | 239/586 |
| 100926 | 7/1916 | United Kingdom | 239/586 |

*Primary Examiner*—Andres Kashnikow
*Assistant Examiner*—Lesley D. Morris
*Attorney, Agent, or Firm*—Hill, Van Santen, Steadman & Simpson

[57] ABSTRACT

A liquid spray gun whih includes an improved flow rate control. The improved flow rate control results from a valve in the supply inlet line which can restrict the flow of liquid material from the supply container. The ability to vary the flow rate is improved because, while the electromagnetic motor is maintained at maximum electrical input power, inlet flow can be accurately regulated. Maintaining maximum input pressure ensures optimum spray performance. Finer atomization at lower flow rates can be achieved from the improved flow control system.

23 Claims, 1 Drawing Sheet

FIG. 1
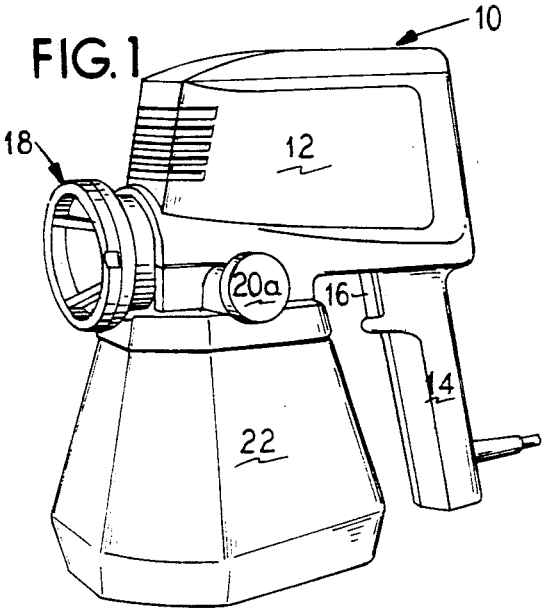
FIG. 3
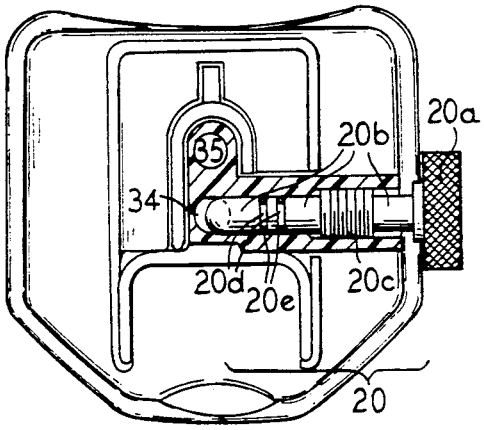
FIG. 2
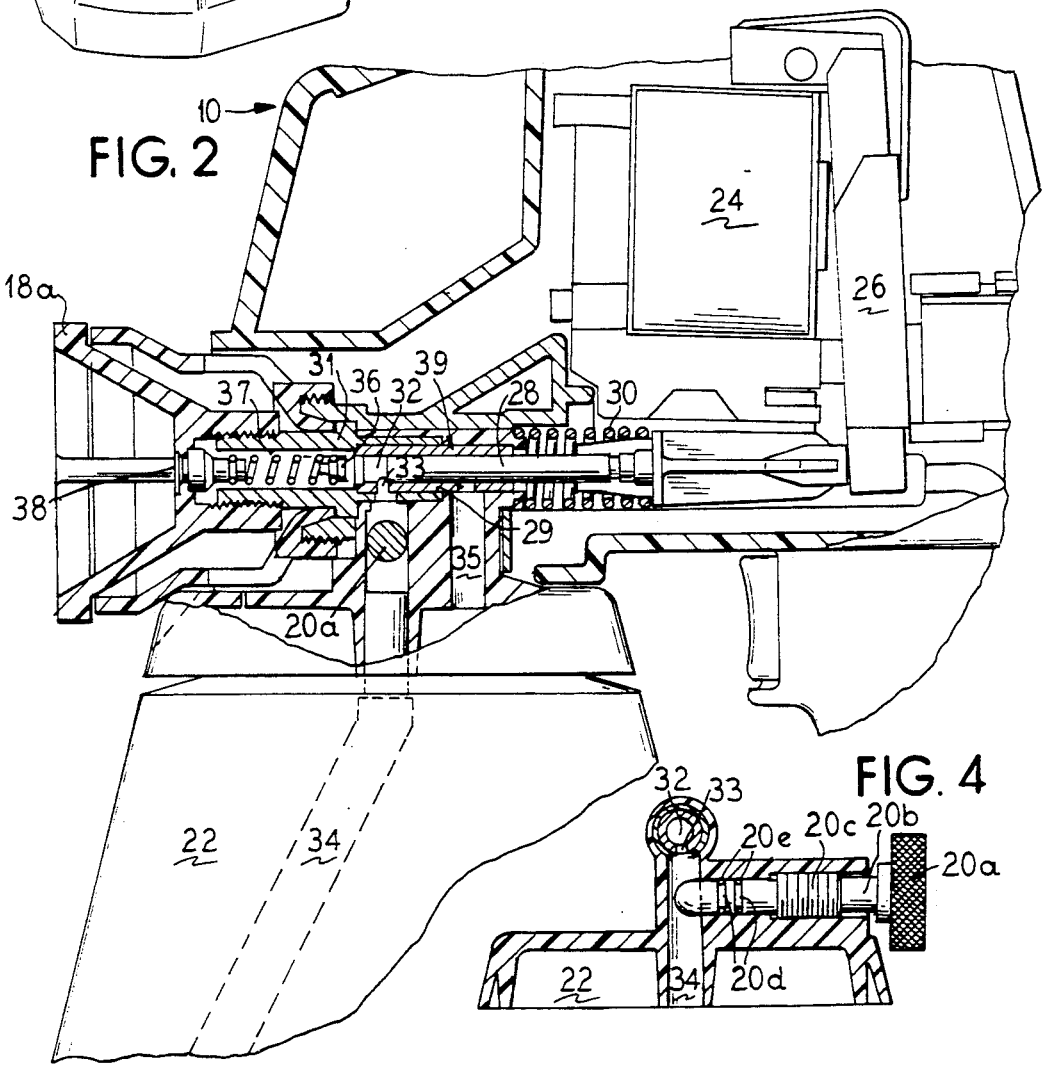
FIG. 4

VARIABLE INLET SPRAYING APPARATUS

This is a continuation of application Ser. No. 427,501, filed Oct. 27, 1989, now abandoned.

BACKGROUND OF THE INVENTION

1. Field of the Invention

The present invention relates to a material flow control for a spraying apparatus and, more particularly, for an airless spray gun for atomizing liquids having a pump piston and pump drive arrangement including a coil and a swinging armature.

2. Description of the Prior Art

Airless spray guns conventionally employ various techniques to limit the flow of liquid out of the spray tip. Well-known devices accomplish this by varying the output of the A-C motor or by limiting the oscillation and stroke length of the armature which drives the piston that will pump the liquid. Various electronic suppression control systems, such as disclosed in U.S. Pat. No. 4,705,995, and mechanical devices, such as disclosed in U.S. Pat. No, 4,744,516, successfully change the stroke length and rate of the swinging armature. However, these known spray guns suffer from inferior atomization quality because they rely on reduction of input power to reduce the flow. Reduction of input power decreases pressure at the spray nozzle which will make it impossible to provide a fine spray. As a result, coarse atomization will occur. Degradation of overall spray performance is attributable to this decrease in pressure at the atomizer.

In none of the known airless spray guns is it possible to control the flow of liquid while maintaining high atomization quality and simplifying the entire control system. No conventional airless spray guns maintain maximum input power while adjusting flow rates, nor do they provide fine atomization at lower flow rates.

SUMMARY OF THE INVENTION

It is an object of the present invention to provide a spray gun whose volume output can be reduced while maintaining optimum atomization of the material being sprayed and optimal, constant input power. A reduction of the throughput quantity of material, such as paint, is possible with the present spray gun.

A further object is to provide an airless spray gun having the following described qualities. They are accomplished by the provision of a material flow control valve. In the present spray gun, the flow of liquid from the supply container is restricted by a control valve which has a regulator knob. The control valve may be a threaded member that can be screwed in and out of the gun housing. The control valve has O-rings to prevent liquid from entering the threaded portion. Fine atomization at lower flow rates can be achieved by the present invention. The user can easily adjust the flow rate for various types of jobs. A reduction in the throughput quantity of material down to a few percent of all output quantity is possible with the present airless spray gun. Thus, even the finest painting jobs can be carried out without any atomization problems. The regulator knob portion of the control valve enables the user to select the desired flow rate with accuracy.

The control valve of the present invention would greatly simplify manufacture of spray guns because it would alleviate the need for multiple nozzles, electronic control modules and armature stroke length/rate controllers.

Therefore, this sprayer would cost less than current sprayers and would resolve problems relating to atomization quality. The simplicity in design would improve performance and reliability. The spray gun of the present invention can be manufactured in an economical and cost-favorable way.

BRIEF DESCRIPTION OF THE DRAWINGS

FIG. 1 is a perspective view of an airless spray gun of the present invention;

FIG. 2 is a partial elevational and longitudinal sectional view of a spray gun of the present invention;

FIG. 3 is a cross-sectional view of the present invention taken along a line through the control valve; and FIG. 4 is a front end sectional view of a spray gun of the present invention.

DETAILED DESCRIPTION OF THE PREFERRED EMBODIMENTS

Referring to the drawings, there is shown in FIG. 1, a spray gun 10 generally, which includes a housing 12 that defines a depending handle 14 with activating switch 16 and spray tip structure 18. A regulator knob 20*a* of control valve 20 regulates the flow of liquid from a removable but secure supply container 22.

Now referring to FIG. 2, the gun 10 includes an A-C electromagnetic motor 24 which drives the pivotally mounted oscillating armature 26 and elongated piston rod 28. Spring 30 gives opposing force to armature 26 to maintain a steady oscillating rate. Piston rod 28 sucks liquid into chamber 32 via inlet line or inlet conduit 34 during each rearward movement of the piston rod.

The piston rod 28 is biased against the armature 26 and is mounted in a cylinder sleeve 29. The cylinder sleeve 29 is mounted in sleeve housing 31. The cylinder sleeve includes a liquid inlet port 33. The sleeve housing includes a leakage port 35 through which blow-by leakage flows along the piston rod 28, then exits the pump 39 and is permitted to flow back into the supply container 22. On its forward stroke, the piston rod 28 forces liquid through a check valve 36 that is mounted in a bore 37 that communicates with nozzle 38. The nozzle is at the center of an open safety nozzle guard 18*a*. The liquid material exits the spray tip 18 in the form of fine spray.

As shown in FIGS. 2, 3 and 4 the inlet line or inlet conduit 34, in the region of the control valve 20, provides a smooth, cylindrical configuration up to the inlet port 33.

The quantity of liquid sucked from the supply container by the piston rod 28 into chamber 32 can be regulated by control valve 20. This control system can be seen in more detail in FIGS. 3 and 4. The control valve 20 has the regulator knob 20*a* for easy operation of the valve, valve shaft 20*b* for actual flow restriction in the inlet line 34, and valve threading 20*c* for securing the control valve 20 to the gun housing and for allowing the user to adjust the depth of penetration into the inlet line with accuracy. The control valve 20 also includes O-rings 20*d* which form a seal to prevent any liquid from touching the valve threading 20*c* or from exiting the housing. O-rings sit in valve grooves 20*e* to remain in place. Turning the regulator knob 20*a* moves the control valve in and out of the inlet line 34. The end of valve shaft 20*b*, that lies in the inlet line, is shaped to provide a form fit with the inside wall of the inlet line.

Very small flow rates can be achieved with such a form fit. This screwing in and out of the control valve will enable the user to fine tune the quantity of liquid flowing into the chamber 32. In operation, the gun is activated by squeezing the trigger switch 16 which activates the A-C electromagnetic motor 24 and the oscillating armature 26 which, in turn, causes the piston pump 39 to reciprocate. The piston rod 28 has a front end 28*a* which oscillates across inlet port 33. As front end 28*a* moves away from check valve 36, it creates a vacuum area in the form of chamber 32. Just before front end 28*a* reaches its full backstroke position, it passes over inlet port 33. Due to the vacuum in chamber 32, liquid in the supply container will be sucked into chamber 32 via inlet line 34. A forward stroke of the piston rod will evacuate chamber 32. This delivers liquid at a high pressure to the nozzle 38 for spraying. Varying the flow of liquid at the spray tip structure 18 is accomplished by turning regulator knob 20*a*. Regulator knob 20*a* can be easily screwed in and out until the desired spray flow is achieved.

Although the invention has been described with respect to the preferred embodiment, it is not to be so limited as changes and modifications can be made which are within the full intended scope of the invention as defined by the appended claims.

We claim as our invention:

1. A spray apparatus for spraying a liquid material, comprising:

a reservoir for storing a supply of said liquid material;

a conduit having a first open end communicating with said reservoir, said conduit having sidewalls providing a flow path for said liquid material;

means for drawing liquid from said reservoir through said conduit, said means communicating with said conduit at a second open end thereof and said means directing said liquid to a discharge opening; and a control valve positioned in a portion of said conduit wherein said sidewalls are of a smooth cylindrical configuration, said control valve having a valve shaft extending perpendicular to said flow path and being movable into and out of said flow path to vary the size of said flow path.

2. A spray apparatus for spraying a liquid material, according to claim 1, wherein said means for drawing liquid from said reservoir comprises a pump positioned between said reservoir and said discharge opening.

3. A spray apparatus for spraying a liquid material according to claim 2, wherein said pump is a reciprocal piston pump.

4. A spray gun for spraying a liquid material, comprising:

a housing;

a pump chamber having an inlet opening and a discharge opening positioned within said housing;

a pumping member mounted in said pump chamber to draw material from said inlet opening and direct it to said discharge opening;

a drive means operably connected to said pumping member for driving said pumping member in said pump chamber;

a reservoir for storing a supply of said liquid material;

an inlet conduit arranged between said pump chamber and said reservoir, having sidewalls defining a flow path connecting said reservoir to said pump chamber inlet opening; and a control valve positioned in a portion of said inlet conduit wherein said sidewalls are of a smooth cylindrical configuration, said control valve having a valve shaft extending perpendicular to said flow path and being movable into and out of said flow path to vary the size of said flow path making said control valve operable to selectively restrict said inlet conduit thereby controlling the flow rate of said material from said reservoir to said pump chamber.

5. A spray gun according to claim 4, wherein said pumping member is a piston and said drive means is an A.C. motor with a coil and a swinging armature operably connected to said piston to cause said piston to oscillate in said pumping chamber.

6. A spray gun according to claim 4, wherein said reservoir is a cup-like container removably secured to said housing.

7. A spray gun according to claim 4, wherein said control valve comprises a threaded member, threadingly received in said housing with a terminal end positioned in said inlet conduit and having a manually engageable knob portion which, when rotated, causes said terminal end to move into and out of said inlet conduit to effect said selective restriction.

8. A spray gun according to claim 4, wherein said spray gun comprises an airless paint sprayer.

9. A spray gun according to claim 4, wherein said drive means provides a constant power input to said pumping member for all positions of said control valve.

10. A spray gun according to claim 4, wherein said valve shaft has a terminal end shaped so as to provide a form fit with said smooth sidewall of said inlet conduit.

11. A spray gun according to claim 4, wherein said control valve has a groove around its circumference and an O-ring sitting therein.

12. An airless spray gun for spraying material from a reservoir, comprising:

a gun-like housing;

a pump piston reciprocally mounted in a pump chamber for pumping material from the reservoir;

a drive arrangement having a coil and a swinging armature for driving said pump piston;

an inlet line flow communicating between said pump chamber and said reservoir, having sidewalls defining a flow path which supplies said material to said pump piston from the reservoir movement of said pump piston causing suction on said inlet line to draw material from said reservoir;

a control valve having a valve shaft extending perpendicular to said flow path and being movable into and out of said flow path at a portion of said inlet line wherein said sidewalls are of a smooth cylindrical configuration to restrict the flow of material from said container to said pump; and a spray tip at one end of the housing communicating with said pump, said spray tip includes a liquid atomizing spray nozzle forming a spray pattern.

13. An airless spray gun as in claim 12, wherein said housing has a threaded opening in a part of the housing that surrounds a portion of said inlet line that is above the supply container and below the pump piston.

14. An airless spray gun as in claim 13, wherein said control valve has a regulator knob, and a threaded section.

15. An airless spray gun as in claim 14, wherein said control valve fits into the threaded opening so that said valve shaft lies with a shaft portion thereof in said inlet line, said threaded section matches with a threaded opening and so that said regulator knob is outside said gun housing.

16. An airless spray gun as in claim 15, wherein the control valve can be screwed in and out of said housing so as to move said shaft portion in and out of said inlet line.

17. An airless spray gun as in claim 12, wherein an end of said valve shaft that lies partially in said inlet line matches the shape of said sidewalls of the inlet line.

18. An airless spray gun in claim 16, wherein said valve shaft comprises a sealing portion between an end of said valve shaft and said threaded section which has a plurality of grooves around its circumference and a plurality of O-rings sitting therein.

19. In a compact, hand-held paint spraying gun having a housing which mounts a reciprocating electrically driven spraying pump mounted over a reservoir and at a front thereof a spray nozzle, the pump drawing liquid from said reservoir through an inlet conduit extending from said pump down into said reservoir, the improvement comprising:

a control valve positioned in a portion of said inlet conduit flow located between said reservoir and said pump, said control valve having a valve shaft selectively extendable into said inlet conduit to vary a size of a flow path therein, said control valve operable from outside the hand-held paint spraying gun.

20. The improvement according to claim 19, wherein the inlet conduit has a region wherein said inlet conduit comprises a smooth cylindrical configuration, and said control valve is positioned for said valve shaft to extend into said region to vary said size of said flow path.

21. The improvement according to claim 20, wherein said pump comprises a piston reciprocating in a pumping chamber and, an AC motor with a coil and a swinging armature operably connected to said piston to cause said piston to oscillate in said pumping chamber.

22. The improvement according to claim 21, wherein the valve shaft comprises a threaded section which is threadingly secured into said housing, and a distal end portion of said valve shaft is extendable into said inlet conduit, said distal end portion is projected or retracted into said inlet conduit by screwing or unscrewing the threaded section into said housing.

23. The improvement according to claim 22, wherein said distal end portion is shaped so as to provide a form fit within an inside wall of said inlet conduit.

* * * * *